United States Patent [19]

Wisebaker

[11] Patent Number: 4,538,437

[45] Date of Patent: Sep. 3, 1985

[54] FORGING MACHINE KICKOUT DRIVE WITH RUNNING ADJUSTMENT

[75] Inventor: Robert E. Wisebaker, Tiffin, Ohio

[73] Assignee: The National Machinery Company, Tiffin, Ohio

[21] Appl. No.: 624,419

[22] Filed: Jun. 25, 1984

[51] Int. Cl.[3] ..... B21D 22/00

[52] U.S. Cl. ..... 72/345; 72/356; 72/427; 10/11 E

[58] Field of Search ..... 72/345, 354, 356, 427, 72/446; 10/11 E, 11 T, 12 T, 72 T, 76 T

[56] References Cited

U.S. PATENT DOCUMENTS

| | | | |
|---|---|---|---|
| 3,120,769 | 2/1964 | Holebur | 72/427 |
| 3,171,144 | 3/1965 | Maistros | 10/76 |
| 3,604,242 | 9/1971 | Allebach | 72/421 |
| 3,802,013 | 4/1974 | Nebendorf | 10/11 E |
| 4,014,203 | 3/1977 | Koch | 72/427 |
| 4,161,113 | 7/1979 | Kline | 72/344 |
| 4,395,899 | 8/1983 | Wisebaker | 72/354 |

*Primary Examiner*—Leon Gilden

*Attorney, Agent, or Firm*—Pearne, Gordon, Sessions, McCoy, Granger & Tilberry

[57] ABSTRACT

An adjustable kickout drive for forming machines is disclosed which can be adjusted while the machine is running. The drive includes a drive cam and a kickout lever, both of which oscillate about pivots. The drive cam is driven through a predetermined angle of oscillation from the main machine drive. The kickout lever is provided with a cam surface adjacent to the drive cam and a roller system is positioned between the cams so that the kickout lever oscillates through an angle in response to the oscillating rotation of the drive cam. The rollers are mounted on a lever, which is in turn pivoted on an adjusting screw which threads through a nut journaled on the machine frame. Rotation of the nut moves the screw, and in turn changes the position of the rollers with respect to the cam surfaces. The drive cam and the kickout lever are provided with straight cam surfaces which are parallel in the operative position of the kickout system so that adjustment of the screw does not change the operative position but only changes the stroke and retracted or rearward position of the kickout drive.

14 Claims, 4 Drawing Figures

FORGING MACHINE KICKOUT DRIVE WITH RUNNING ADJUSTMENT

BACKGROUND OF THE INVENTION

This invention relates generally to forging machines, and more particularly to a novel and improved kickout drive for such machines which can be adjusted while the machine is running.

PRIOR ART

Forming machine, such as forging machines, often provide a kickout system which operates to eject a workpiece from a die after it has been formed within the die. Generally, such kickout systems provide a drive which is adjustable only while the machine is shut down. Examples of such kickout drives are illustrated in U.S. Pat. Nos. 3,171,144; 3,604,242; and 4,161,113. Generally, the adjustment provided is arranged to adjust only the retracted or rearward position and the forward or operative position of the kickout drive is not changed by such adjustment.

Further, in some instances, kickout systems have been provided with adjustable drives which can be adjusted while the machine is running. One example of such a system providing running adjustment is illustrated in U.S. Pat. No. 4,395,899. All of the aforementioned patents are assigned to the assignee of the present invention.

SUMMARY OF THE INVENTION

The present invention provides a novel and improved kickout drive the stroke of which can be adjusted while the machine is running. The illustrated drive allows the rearward or retracted position of the drive to be adjusted without changing the forward or operative position. Such kickout drive is particularly adapted for use in multistation machines, and permits the independent running adjustment of the kickout at each workstation.

In the illustrated machine, the kickout drive includes a cross shaft journaled on the machine frame and driven by a linkage for oscillating rotation through a predetermined angle from a first position to a second position in timed relationship to the operation of the machine. The kickout drive for each workstation includes a drive cam mounted on such cross shaft. Positioned adjacent to each drive cam is a kickout lever, also journaled for oscillating rotation. Each kickout lever provides an output projection which extends into alignment with the associated kickout rod assembly and another projection which provides a straight kickout lever cam surface adjacent to the cam surface of the associated drive cam.

An adjustable connection is provided between each drive cam and its associated kickout lever which includes rollers positioned between the two cam surfaces. These rollers are pivotally mounted on one end of an adjustment link, which is in turn pivoted at its other end on an adjusting screw. The adjusting screw is in turn threaded through a nut axially positioned between two frame surfaces.

Rotation of the nut operates to move the screw and, in turn, the connected end of the adjusting link. This in turn changes the position of the rollers with respect to the associated cam surfaces, and thereby changes the angle through which the associate kickout lever oscillates in response to the oscillation of the associated drive cam.

The cam surface of the drive cam is provided with a constant radius portion and a straight tangential portion which is positioned parallel to the straight cam surface of the associated kickout lever when the drive cam is in one extreme of its oscillation and when the kickout lever is in forward or operative position. Further, the adjustment system is arranged so that the roller is positioned between both straight and parallel cam surfaces in all adjusted positions when the kickout lever is in its operative position. Therefore, adjustment of the position of the rollers does not affect the forward or operative position of the kickout lever, but only affects the rearward or retracted position.

Because the nut does not move during the operation of the machine, the nut can be rotated while the machine is running to provide a running adjustment of the kickout stroke.

In the illustrated embodiment, the outer surface of the nut is provided with a worm gear which is engaged by a worm screw. Therefore, rotation of the worm screw rotates the nut when adjustment is required. A piston and cylinder actuator is also provided to lock the adjustment screw in its adjusted position.

The roller drive system, with its adjustment screw, provides a simple and reliable structure to provide a running adjustment, and further eliminates sliding surfaces which tend to produce wear during the operation of the machine.

These and other aspects of this invention are illustrated in the accompanying drawings, and are more fully described in the following specification and drawings.

DETAILED DESCRIPTION OF THE DRAWINGS

Figure 1:
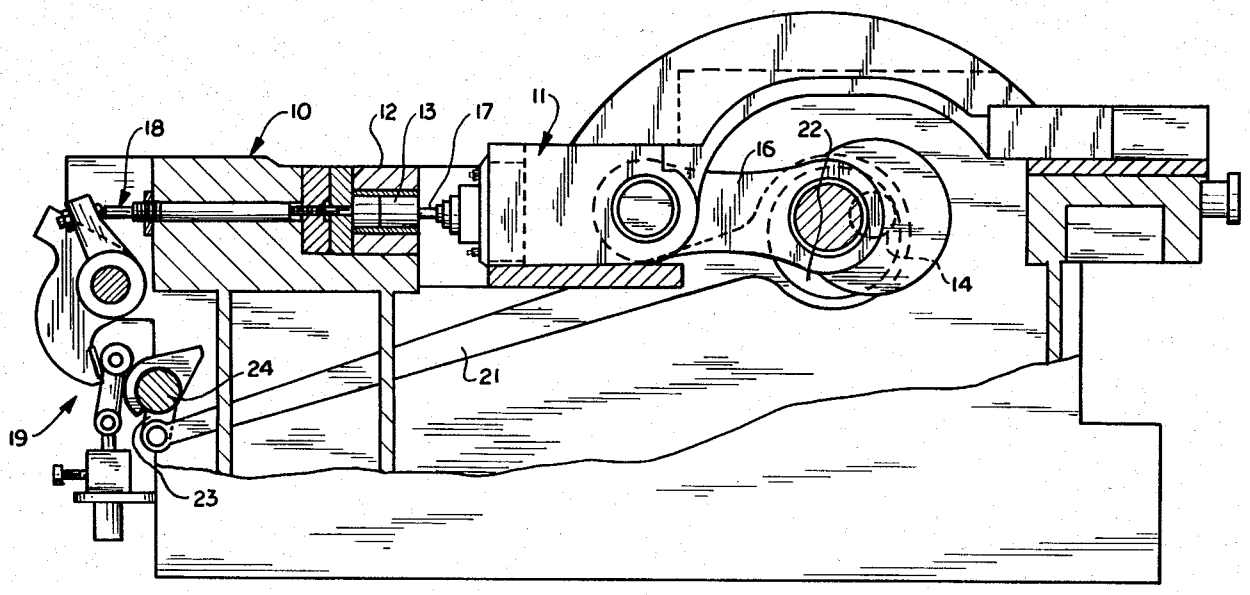
FIG. 1 is a side elevation, partially in section, illustrating a forming machine incorporating a kickout system in accordance with the present invention.

Referring to FIG. 1, a typical forming machine of the type to which this invention is particularly suited includes a frame 10, a slide 11 reciprocable on the frame, and a die breast 12 in which dies 13 are mounted. The machine is provided with a plurality of workstations each of which includes a die 13 mounted in the die breast, in which workpieces are progressively formed. The slide 11 is powered by a rotating crankshaft 14 connected to the slide by a pitman 16. Tools 17 are mounted on the slide 11 at each workstation to form the workpieces in the dies 13. Transfer means (not shown) of any suitable type such as the type illustrated in U.S. Pat. No. 3,604,242, are provided to transfer the blanks progressively to each die station.

A kickout system includes kickout rods 18 which extend forward into the associated die and operate to eject the workpieces from the dies 13 into the transfer mechanism after each working stroke and while the slide is spaced back from the dies. U.S. Pat. No. 3,171,144 discloses in detail one such kickout rod assembly, and such patent is incorporated herein by reference. The drive assembly 19 of the kickout system is powered by a drive link 21 journaled on an eccentric cam 22 mounted on the crankshaft 14 and on an arm 23 projecting laterally from a cross shaft 24 journaled on the rearward end of the frame and extending across the frame. The eccentric 22 and the arm 23 are proportioned so that the cross shaft 24 oscillates around its pivot axis through a predetermined angle from a first position to the second position. Because the cross shaft 24 and slide 11 are both powered by the crankshaft 14, the timing of the oscillations of the cross shaft 24 are automatically time with the operation of the machine.

Figure 2:
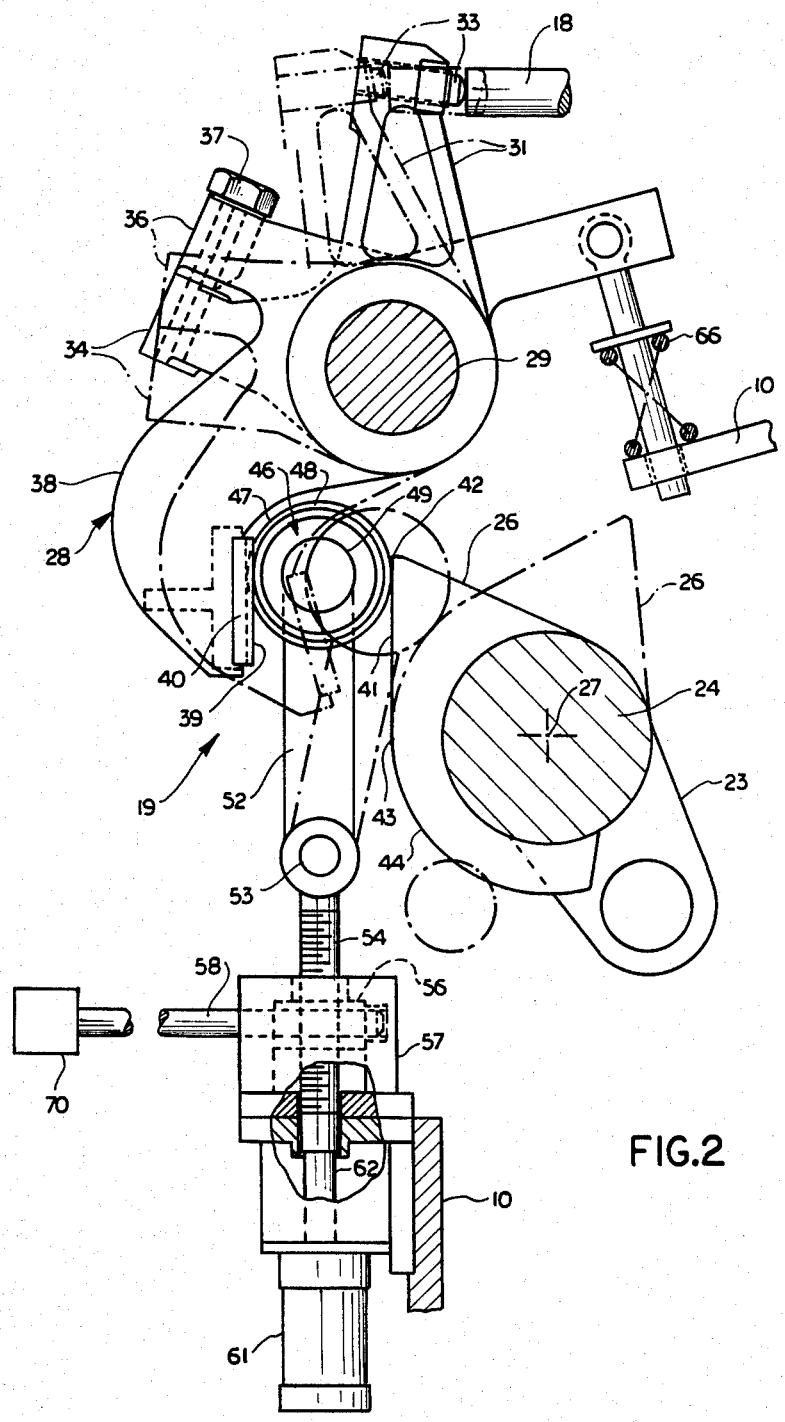
FIG. 2 is an enlarged, fragmentary view of the kickout drive, with parts broken away for purposes of illustration, having the drive in full line in the operative position and in phantom in the retracted position, and illustrating the adjustment positioned for maximum kickout stroke.

FIG. 2 illustrates one of the drive assemblies 19 associated with one of the workstations of the machine. It should be understood that a similar drive assembly is provided for each workstation. In FIG. 2, the drive mechanism is illustrated in full-line in its operative or forward position, and in phantom in its retracted or rearward position. The drive mechanism includes a drive cam 26 mounted on the cross shaft 24 for oscillation through a fixed angle from the full-line position to the phantom position. In the illustrated embodiment, the angle of oscillation of the drive cam 26 is about 60 degrees, and the rotation occurs about the axis 27 of the cross shaft 24.

Positioned adjacent to the drive cam 26 is a two-part kickout lever 28 journaled for oscillating rotation on a pivot shaft 29. One part of the kickout lever is provided with an output projection 31 which extends up into alignment with the rearward end of the kickout rod 18 and provides an adjusting screw 33 which actually engages the rearward end of the kickout rod assembly 18. Such first kickout lever part also provides a projection 34 positioned adjacent to a projection 36 on the other kickout lever part. A breaker bolt 37 clamps the two projections 34 and 36 together so that the two kickout lever parts operate as a single kickout lever during normal operation. The breaker bolt 37, however, is sized so that it will break to prevent damage to the kickout drive in the event excessive loading conditions occur. The other kickout lever part provides a cam projection 38 which supports a straight cam shoe 40 substantially adjacent to the drive cam 26 which provides two parallel straight cam surfaces.

The drive cam 26 is formed with two cam portions. The first cam portion 41 extends from an end 42 to about the point 43 where it joins a second cam portion 44. The second cam portion 44 is formed with a uniform radius with respect to the axis 27 and the first cam portion is a straight cam portion which tangentially intersects the second cam portion 44. Therefore, the cam portion 44 is a dwell portion and the cam portion 41 is a lift portion.

Positioned between the two cam surfaces 39 and 41 is a roller assembly 46 providing a central roller 47 and two separate side rollers 48, with one positioned on each side of the central roller 47. The central roller 47 and the two side rollers 48 are journaled for rotation on a pivot 49. The central roller 47 rolls along the cam surfaces 41 and 44 of the drive cam 26, while the side rollers 48, which are slightly smaller in diameter, roll along the straight cams 39 carried by the kickout lever 28. The cam shoe is provided with a central recess sized to clear the surface of the central roller and provides two parallel and laterally spaced, identical roller cam surfaces 39 which are engaged by the side rollers 48.

The pivot 49 for the rollers 47 and 48 is carried by one end of an adjusting link 52, the other end of which is journaled on a pivot 53 carried by an adjusting screw 54. The adjusting screw 54 extends through a nut 56 journaled in a housing 57 for rotation with respect to the housing but is fixed axially within the housing. When the nut 56 is rotated, the screw 54 moves up and down, as viewed in FIG. 2, to change the position of the line 52 and, in turn, change the position of the rollers 47 and 48 with respect to the various cam surfaces.

Rotation of the nut is provided by a worm screw 58 which engages worm wheel grooves formed in the periphery of the nut 56. Because the housing 57 is mounted on the frame of the machine 10 and does not move during machine operation, the adjustment of the screw 54, and in turn the drive, can be performed while the machine is running.

Once the adjustment is completed, the screw 54 is locked in its adjusted position by a locking actuator including a piston 61 mounted on the housing 57 and a piston 62 which extends into engagement with the inner end of the screw 54. The engagement between the piston 62 and the end of the screw frictionally locks the adjustment screw, and also functions to urge the nut 56 upwardly against the adjacent wall of the housing 57 to ensure that all clearances are removed. Therefore, the screw is precisely positioned in its adjusted position.

Figure 3:
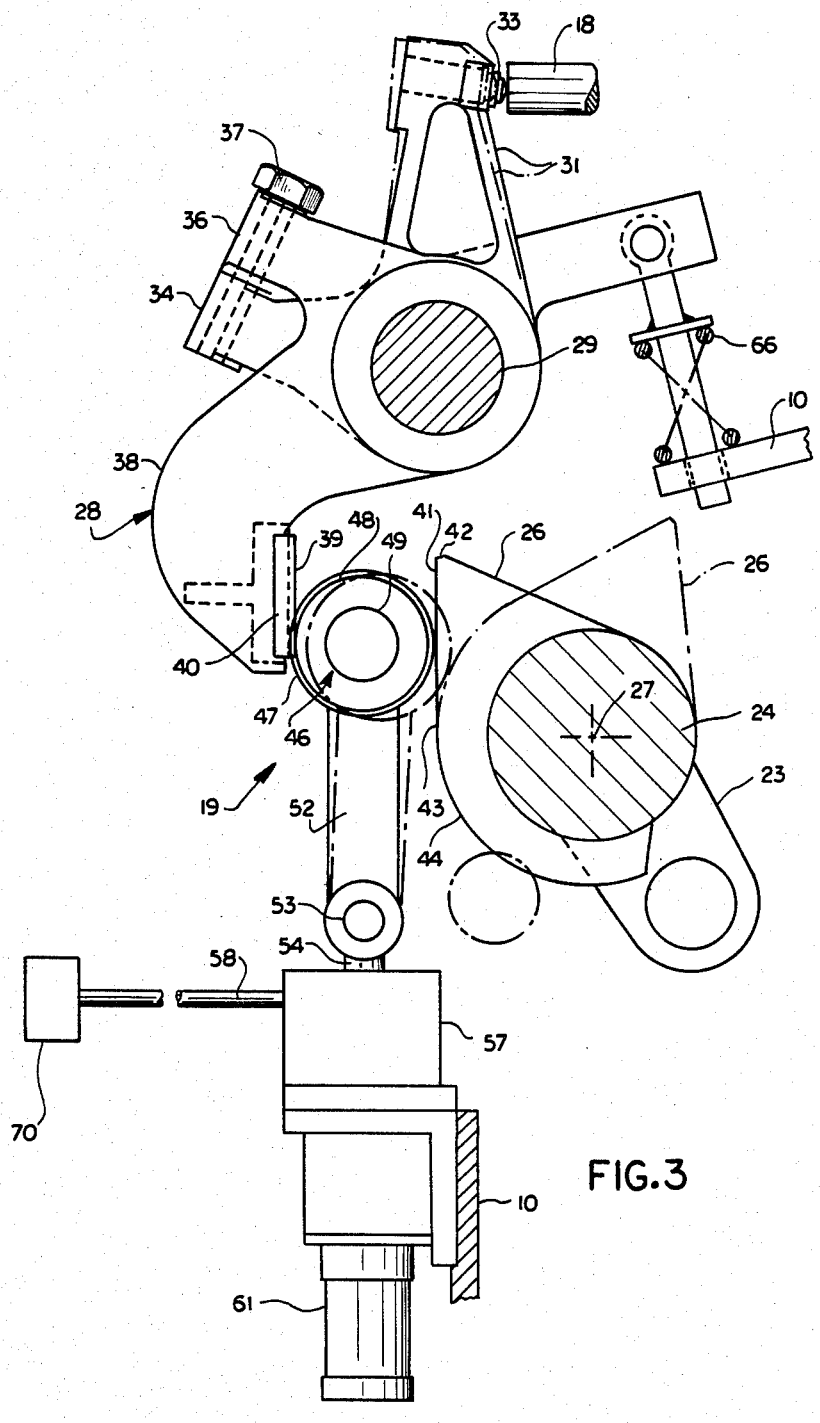
FIG. 3 is a fragmentary view similar to FIG. 2, showing the adjustment positioned for minimum stroke.
Figure 4:
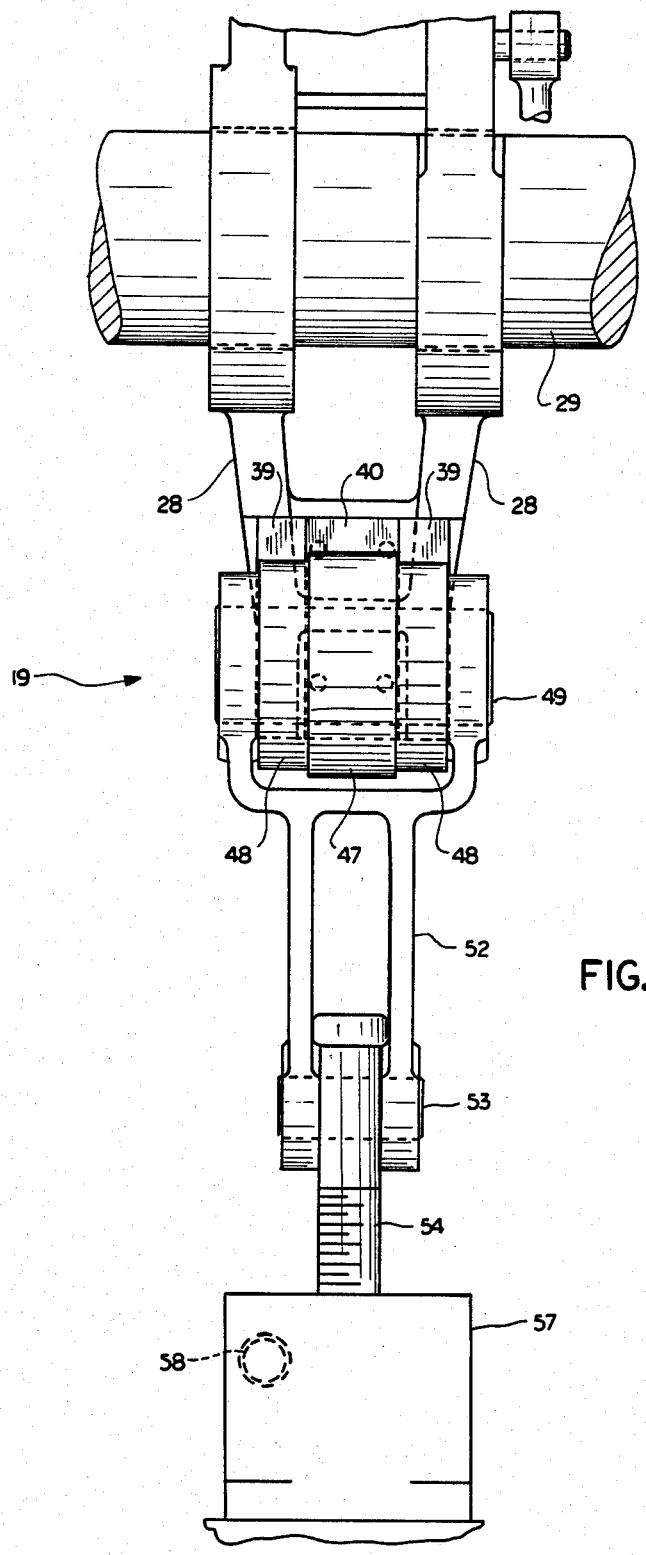
FIG. 4 is a fragmentary view of the kickout drive taken along a plane perpendicular to the plane of the view of FIGS. 2 and 3.

The operation of the adjustment for changing the stroke or the angle through which the kickout lever rotates is best understood by comparing FIGS. 2 and 3. In FIG. 2, the adjustment is positioned for maximum kickout lever stroke. In such position, the screw 54 is extended and the drive mechanism moves between the phantom line retracted position and the full-line extended or operative position when the drive cam 26 rotates through its predetermined angle of oscillation. The various elements are proportioned so that the straight cam surface 39 is parallel to the straight cam surface 41 when the kickout drive is in the operative position. However, when the drive cam 26 rotates in a clockwise direction to the phanom line position, the various elements move to the phantom line position in which the center roller 47 engages the cam surface of the drive cam 26 at about the point 43 of intersection between the first cam surface 41 and the second cam surface 44. During such movement of the drive cam, the side rollers 48 do not roll to any significant degree along the straight cam surfaces 39 of the kickout lever, but allow such lever to rotate in an anticlockwise position from the full-line position to the phantom line position. A schematically illustrated compression spring 66 provides a spring bias on the kickout lever in an anticlockwise direction to cause the cam surface 39 to follow the rollers as the drive cam 26 moves to its retracted phantom line position.

The stroke of the kickout drive is relatively large in this adjusted position of the drive, as illustrated by a comparison of the two positions of the adjusting screw 33.

Reference should now be made to FIG. 3, which shows the kickout drive in an adjusted position or substantially minimum stroke. In such position, the screw 54 has been lowered, as viewed in FIG. 3, from the extended position of FIG. 2. In such position, the rollers 47 and 48 have also been lowered and are spaced further from the pivot 29 so that they engage the straight cam surfaces 39 substantially adjacent to the remote ends thereof. This also lowers the rollers with respect to the straight first cam surface 41 of the drive cam 26.

When the drive cam 26 is in the full-line or operative position and when the rollers are adjusted to the position of FIG. 3, the roller 47 engages the straight cam surface 41 at a location substantially spaced from the outer end 42 thereof. Consequently, as the drive cam 26 rotates toward the retracted phantom position, the central roller 47 rolls past the intersection 43 between the two cam surfaces 41 and 44 and down along the radial portion 44 of the cam. Consequently, in this adjusted position, the rollers do not move back and forth through as great a distance, and as a result the oscillating rotation of the kickout lever 28 is much smaller. This is demonstrated by a comparison of the two positions of the adjusting screw 33 in FIG. 3.

Because the first cam surface 41 of the drive cam 26 is parallel to the straight cams 39 of the kickout lever 28 when the drive cam 26 is in its operative position, the adjustment of the position of the rollers does not affect the forward or operative position of the kickout lever 28. The adjustment merely changes the stroke of the kickout lever, and in turn the retracted position.

With the present invention, it is possible to adjust the kickout drive while the machine is running. Also with the preferred structure illustrated, rolling engagement is provided between each of the cam surfaces engaged by the rollers 47 and 48. Consequently, wear is virtually eliminated and a reliable, easily maintained system is provided. The system is further arranged so that the adjusting worm screw 58 extends rearwardly of the machine so that a similar adjustable drive can be provided for each of the workstations and the adjustment of the drive for one workstation does not interfere with the adjustment of the drives for the other workstations. The worm screw can be operated manually or it can be connected to a power drive schematically illustrated by the block 70. Further, suitable indicators can be provided to give a visual indication of the adjusted position of the mechanism.

Although the preferred embodiment of this invention has been shown and described, it should be understood that various modifications and rearrangements of the parts may be resorted to without departing from the scope of the invention as disclosed and claimed herein.

What is claimed is:

1. A kickout drive for forming machines having a frame comprising a drive cam journaled on said frame for oscillating rotation through a predetermined angle from a first position to a second position and providing a first cam surface, a kickout lever journaled on said frame and providing a second cam surface substantially adjacent to said drive cam, said kickout lever also providing an output portion operating a kickout in response to oscillation of said kickout lever, and adjustable drive means interconnecting said drive cam and said kickout lever and operating to oscillate said kickout lever in response to oscillation of said drive cam, said adjustable drive means including a connecting portion engaging both of said cam surfaces and positioning means fixed to said frame operable to adjust the position of said connecting portion with respect to said drive cam and kickout lever, said positioning means operating to change the angle through said kickout lever oscillates in response to oscillation of said drive cam through said predetermined angle.

2. A kickout drive as set forth in claim 1, wherein said drive cam and kickout lever cam provide straight cam portions which are parallel when said drive cam is in said first position and said kickout lever is in one extreme position of its oscillation, adjustment of said connecting portion changing the angle of oscillation of said kickout lever without changing said one extreme position thereof.

3. A kickout drive as set forth in claim 2, wherein rollers provide said connecting portion, and said positioning means includes a lever on which said rollers are journaled.

4. A kickout drive as set forth in claim 3, wherein one of said cam surfaces provides a dwell portion and one of said straight portions, adjustment of said rollers changing the distance along which said rollers move along said dwell portion.

5. A kickout drive as set forth in claim 4, wherein said positioning means includes a screw threaded through a nut journaled on said frame, rotation of said nut with respect to said frame permitting adjustment of said kickout drive while said machine is operating.

6. A kickout drive as set forth in claim 3, wherein said lever is journaled on an adjustment member mounted on said frame for movement relative thereto only for adjustment of the position of said rollers.

7. A kickout drive as set forth in claim 6, wherein said adjustment member is a screw threaded through a nut journaled on said frame, and lock means operate to lock said screw in its adjusted position.

8. A kickout drive for forging machines comprising a first cam journaled for oscillation about a pivot axis through a predetermined angle, a second cam journaled for oscillation about a second axis, one of said cams providing a cam surface including a first cam portion of uniform radius and a second straight cam portion tangentially intersecting said first cam portion, the other of said cams providing a straight cam surface, an adjustable connector engaging said cam surfaces of both of said cams and operating to cause said second cam to oscillate in response to oscillations of said first cam, both of said straight cam surfaces being engaged by said connector and being parallel when said first cam is in one extreme of its movement, adjustment of said connector changing the angle of oscillation of said second cam in response to oscillations of said first cam through said predetermined angle.

9. A kickout drive as set forth in claim 8, wherein said connector is provided by rollers positioned between said cam surface, and adjustment of said rollers changes the angle of oscillation of said second cam without changing the position of said second cam when said first cam is in said one extreme of its movement.

10. A kickout drive as set forth in claim 9, wherein said rollers are journaled on one end of the lever, and the other end of said lever is pivoted on an adjusting member which does not move when said machine operates so that it can be adjusted while said machine operates.

11. A forming machine comprising a frame, a slide reciprocable on said frame, tooling on said frame and slide operable to form workpieces, and a kickout system on said frame movable through an adjustable stroke to an operative position to eject workpieces from said tooling; said kickout including a kickout drive providing a drive cam, a driven cam, and an adjustable connector positioned between said cams, said drive cam oscillating through a predetermined angle in timed relation to the reciprocation of said slide and operating through said connector to oscillate said driven cam to an angle determined by the adjustment of said connector, and adjustable means mounted on said frame in a fixed position operable to adjust the position of said connector while said machine is running, adjustment of said connector adjusting the stroke of said kickout system without changing the operative position thereof.

12. A forming machine kickout drive comprising a frame, a drive cam journaled on said frame for oscillation relative thereto about a predetermined angle, a driven cam journaled on said frame providing an output portion operable through a variable stroke to eject workpieces, one of said cams providing a dwell portion and a lift portion, the other of said cams providing a lift portion, connector means positioned between said cams operating to oscillate said driven cam in response to oscillation of said drive cam through an angle determined by the position of said connector means, and adjustment means operable to adjust the position of said connector means with respect to said cams, said adjustment means including a lever on which said connector means is mounted and providing a lever pivot spaced from said connector means, and a lever pivot support member connected to said lever pivot and mounted on said frame for movement relative thereto, movement of said pivot support member relative to said frame adjusting the position of said connector means with respect to said cams.

13. A forming machine as set forth in claim 12, wherein said connector means are roller means journaled on said lever.

14. A forming machine as set forth in claim 12, wherein said pivot support is a screw threaded through a nut journaled on said frame, rotation of said nut operating to axially move said screw with respect to said frame.

* * * * *